US010822195B2

(12) United States Patent
Chapman et al.

(10) Patent No.: US 10,822,195 B2
(45) Date of Patent: Nov. 3, 2020

(54) ELEVATOR SYSTEM INCLUDING DYNAMIC ELEVATOR CAR CALL SCHEDULING

(71) Applicant: OTIS ELEVATOR COMPANY, Farmington, CT (US)

(72) Inventors: Ashley Chapman, Plainville, CT (US); Eric C. Peterson, East Longmeadow, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/383,782

(22) Filed: Dec. 19, 2016

(65) Prior Publication Data

US 2017/0174469 A1 Jun. 22, 2017

Related U.S. Application Data

(60) Provisional application No. 62/270,666, filed on Dec. 22, 2015.

(51) Int. Cl.
*B66B 1/24* (2006.01)
*B66B 9/00* (2006.01)

(52) U.S. Cl.
CPC ..... *B66B 1/2408* (2013.01); *B66B 9/00* (2013.01); *B66B 1/2433* (2013.01); *B66B 1/2458* (2013.01); *B66B 2201/211* (2013.01)

(58) Field of Classification Search
USPC ..... 187/247
See application file for complete search history.

(56) References Cited

U.S. PATENT DOCUMENTS 3,561,571 A * 2/1971 Gingrich ..... B66B 1/2458 187/387
4,007,812 A * 2/1977 Nelson, Jr. ..... B66B 1/18 187/383
4,240,527 A * 12/1980 Vine ..... B66B 1/18 187/387
4,793,443 A * 12/1988 MacDonald ..... B66B 1/2458 187/387
5,979,607 A 11/1999 Allen
6,000,504 A * 12/1999 Koh ..... B66B 1/20 187/380

(Continued)

OTHER PUBLICATIONS

European Search Report for European Application No. 16205977.8, dated Jul. 28, 2017, 8 pages.

*Primary Examiner* — Christopher Uhlir
(74) *Attorney, Agent, or Firm* — Cantor Colburn LLP

(57) ABSTRACT

An elevator system includes at least one elevator car, and an elevator drive system configured to drive the elevator car in a first direction and a second opposing direction based on at least one drive command signal. The elevator system further includes an electronic elevator control module that determines a first servicing route and a second servicing route. The first servicing route services a first floor located along the first direction in response to at least one first call request. The second servicing route overrides the first servicing route so as to dynamically service at least one second floor located along the second direction based on a comparison between at least one parameter of the at least one elevator car and at least one interrupt criteria.

18 Claims, 6 Drawing Sheets

(56) References Cited

U.S. PATENT DOCUMENTS

| | | | | |
|---|---|---|---|---|
| 7,975,808 | B2 * | 7/2011 | Smith | B66B 1/2458 187/247 |
| 8,172,043 | B2 * | 5/2012 | Hughes | B66B 1/2458 187/382 |
| 8,276,715 | B2 * | 10/2012 | Smith | B66B 1/2458 187/247 |
| 2004/0055828 | A1 | 3/2004 | Kavounas | |
| 2010/0217657 | A1 | 8/2010 | Gazdzinski | |
| 2011/0251725 | A1 | 10/2011 | Chan | |

* cited by examiner

ELEVATOR SYSTEM INCLUDING DYNAMIC ELEVATOR CAR CALL SCHEDULING

CROSS REFERENCE TO RELATED APPLICATIONS

This application is a Non-Provisional Application of Provisional Application Ser. No. 62/270,666, filed Dec. 22, 2015, which is incorporated herein by reference in its entirety.

TECHNICAL FIELD

The present invention generally relates to elevator systems, and more particularly, to an elevator car control system.

BACKGROUND

Traditionally, elevator systems complete a first call schedule according to a servicing route traveling in one direction (e.g., down) before invoking a new servicing route traveling in an opposite direction (e.g., up) to service a second schedule. It is not uncommon for a call schedule to include multiple call requests. Therefore, the elevator car may make multiple stops along the servicing route before completing the call schedule. In many instances, especially those occurring in high-rise buildings, potential passengers located a far distance away from the elevator car incur an extensive time waiting for the elevator to complete the first call schedule before the elevator system invokes the new servicing route to service the waiting passenger's called floor. In fact, there are some scenarios where a passenger's wait time in the hallway is longer than the amount of in-elevator time necessary to deliver that passenger to their desired floor.

As shown in FIG. 1, an elevator system 100, includes an elevator car 102 that services a plurality of floors 104*a*-104*e*. A desired travel route 106 is assigned to a respective floor 104*a*-104*e* in response to a car call request input, for example, by a respective waiting passenger 108. According to a traditional elevator system 100, the elevator car 102 follows a first servicing route 110 to service one or more passengers 108. In the case illustrated in FIG. 1, for example, a first passenger 108*e* is shown waiting at the fifth floor 104*e*, a second passenger 108*d* is shown waiting at the fourth floor 104*d*, and a third passenger 108*a* is shown waiting at the first floor 104*a*. In order to complete the first servicing route 110, the conventional elevator system 100 first services the passenger 108*d* at the fourth floor 104*d*, and continues driving the elevator car 102 according to a first car travelling direction 112*a* so as to service the passenger 108*a* located at the first floor 104*a*. Only after servicing the first floor 104*a* (B) does the elevator car 102 change travelling directions 112*b* and continue performing the first servicing route 110 so as to service the passenger 108*e* located at the fifth floor 104*e* (C). Therefore, the passenger 108*e* waiting on the fifth floor 104*e* is the last passenger to receive service and therefore incurs a significant waiting time despite the last passenger being close to the elevator car 102 when the car is servicing the initial passenger at the fourth floor 104*d*.

In another scenario, an elevator car may be in the process of completing service to a called floor (e.g., closing the elevator doors) when a new passenger arrives in the presence of the elevator car and requests service. Traditional systems, however, may disregard the new passenger's request and continue operating according to the first call schedule. The late arriving passenger must therefore wait for the elevator car to complete the first call schedule before the elevator system invokes a new servicing route and returns to service late arriving passenger's floor. In the meantime, the late arriving passenger may abandon the desire to ride the elevator car thereby causing the elevator car to service an empty floor.

SUMMARY

According to a non-limiting embodiment, an elevator system includes at least one elevator car, and an elevator drive system configured to drive the at least one elevator car in a first direction and a second opposing direction based on at least one drive command signal. The elevator system further includes an electronic elevator control module that determines a first servicing route and a second servicing route. The first servicing route services a first floor located along the first direction in response to at least one first call request. The second servicing route overrides the first servicing route so as to dynamically service at least one second floor located along the second direction based on a comparison between at least one parameter of the at least one elevator car and at least one interrupt criteria.

According to another non-limiting embodiment, a method of scheduling a call request of at least one elevator car included in an elevator system comprises configuring the at least one elevator car to travel in a first travel direction and an opposing second travel direction based on at least one drive command signal. The method further includes determining a first servicing route for servicing a first floor located along the first travel direction in response to at least one first call request, and comparing at least one parameter of the at least one elevator car and at least one interrupt criteria. The method further includes overriding the first service route and dynamically scheduling at least one second floor to be serviced in an opposing second travel direction according to a second servicing route in response to the at least one parameter satisfying the at least one interrupt criteria

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Various non-limiting embodiments may decrease the wait time of passengers requesting an elevator car by providing a dynamic car call scheduling control system that dynamically schedules servicing of one or more floors based on a comparison between at least one parameter of the at least one elevator car and at least one interrupt criteria. The various parameters of the elevator car include, but are not limited to, a current position of the elevator car, and the interrupt criteria includes, but is not limited to a floor location corresponding to a second car call request.

In at least one non-limiting embodiment, the elevator control system compares the distance of the elevator to the floor location corresponding to the second car request. When the distance is equal or less than a distance threshold, (i.e., less than or equal to two floor away from the elevator's current position), the elevator control system overrides an initial servicing route corresponding to a first travel direction (e.g., down). The override may include temporarily halting the initial servicing route, dynamically generating a second servicing route including the floor corresponding to the second car request, and driving the elevator car in an opposing second direction (e.g., up) so as to service the second floor. In this manner, the elevator system according to at least one non-limiting embodiment is not required to complete the first servicing route before servicing the new passenger waiting at the second floor. As a result, the waiting time of the new waiting passenger may be significantly reduced.

Additional non-limiting embodiments implement multiple elevators in signal communication with one another, e.g. directly or through a multi-elevator group elevator controller. The elevators may communicate exchange data indicating various parameters, for example, their locations with respect to one another. Based on the exchanged data, one or more of the elevators may dynamically interrupt a current servicing route traveling along a first travel direction (e.g., down), generate a second servicing route including a new floor located in an opposing second travel direction (e.g., up), and provide service to the passenger waiting on the new floor. Once servicing of the second floor is complete, the elevator system can reinitiate the initial servicing route so as to deliver the passengers to their desired locations along the initial servicing route.

Figure 1:
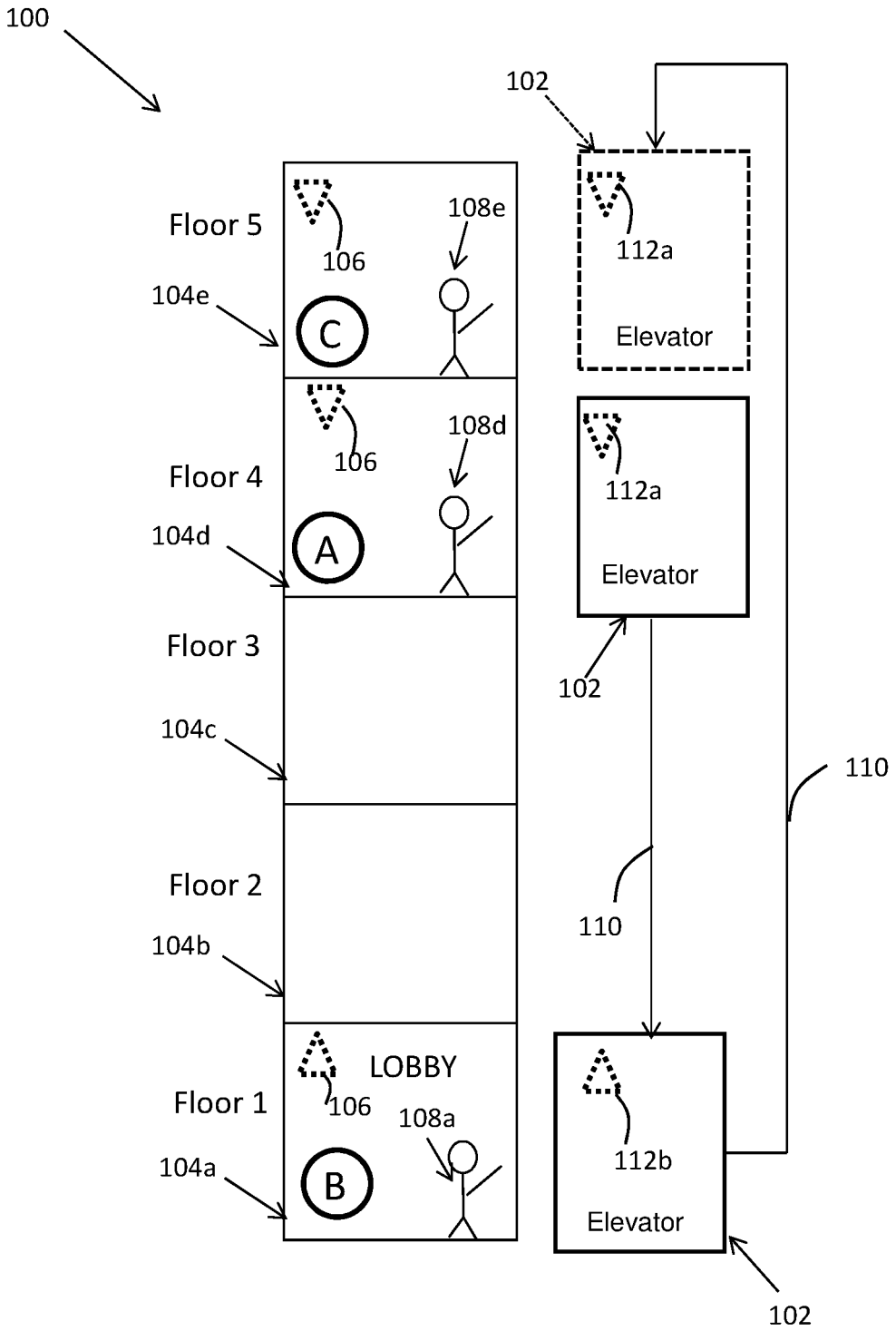
RELATED ART FIG. 1
FIG. 1 is a block diagram illustrating a conventional elevator system.
Figure 2:
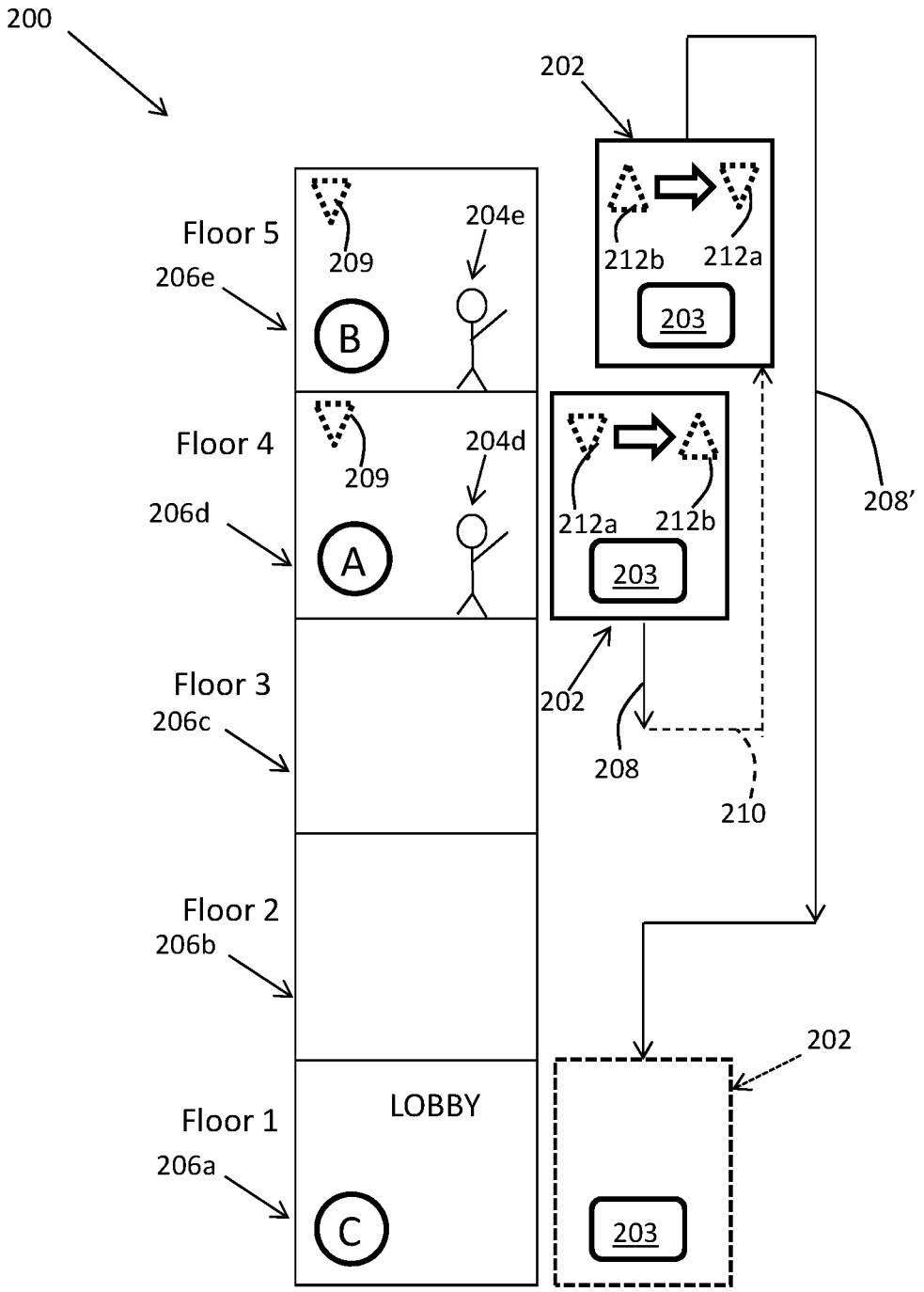
FIG. 2 is a block diagram illustrating an elevator system including dynamic car call scheduling according to a non-limiting embodiment.

With reference now to FIG. 2, an elevator system 200 is illustrated according to a non-limiting embodiment. The elevator system 200 includes one or more elevator cars 202 configured to travel in a first direction and a second opposing direction based on at least one drive command signal generated by an electronic elevator control module. Although the elevator control module 203 is illustrated as being installed in the elevator car 102, it should be appreciated that the elevator control module may be installed in an area remotely located from the elevator car 202. As understood by one of ordinary skill in the art, the elevator system 200 may include an elevator drive system that drives the elevator car in the first and second directions based on the drive command signal generated by the elevator control module 203. In this manner, the elevator car 202 may travel in a first and opposing second traveling direction to service passengers 204 waiting at a respective floor 206*a*-206*e*.

The electronic elevator control module 203 is configured to determine a first servicing route for servicing a first floor located along a first direction (e.g., down) in response to at least one first call request input, for example, by a waiting passenger. Unlike conventional elevator systems, however, the electronic control module 203 is configured to determine a second servicing route 210 which overrides the first servicing route 208. In this manner, the electronic elevator control module 203 may dynamically service at least one second floor located along an opposing second travelling direction without having to first complete the first servicing route 208. By generating the second servicing route 210 without requiring completion of the first servicing route 208, non-desirable extended waiting periods of passengers 204 located along the second servicing route 210 can be avoided, as discussed in greater detail below.

Still referring to FIG. 2, operation of the elevator system 200 is illustrated according to a non-limiting embodiment. The elevator control module 203 generates a first servicing route 208 (A) based on a desired travelling direction 209 input by the passenger 204*d* waiting at the fourth floor 206*d*. Accordingly, the elevator control module 203 assigns a first car direction 212(*a*) to the first servicing route 208. Thereafter, the elevator control module 203 receives a subsequent car request (B) from a second passenger 204*e* waiting at the fifth floor 206*e*.

The elevator control module 203 compares at least one parameter of the elevator car 202 to at least one interrupt criteria. The at least one parameter includes, but is not limited to, a current position of the elevator car 202, and the at least one interrupt criteria includes, but is not limited to, a floor location corresponding to the subsequent call request. Additional parameters may include the amount and distribution of pending demand. Additional interrupt criteria may include a comparison between the estimated time to serve existing demand and the estimated time to serve recent demand which would require a change in scheduled direction, and could be dynamic (e.g. turn around if the time increment is less than 10% of the estimated time to service original schedule) rather than a static threshold (e.g. turn around if change is <2 floors).

According to a non-limiting embodiment, the interrupt criteria could be time-based (e.g. turn around if service time of existing schedule is greater than 2 minutes), and/or logically computed through simple terms (e.g. turn around if service time of existing schedule is greater than two minutes AND late demand is within 3 floors). Interrupt criteria could also be based on complex logic criteria (e.g. turn around if [service time >2 minutes AND distance <3 floors] OR [service time >4 minutes AND distance <4 floors]).

In at least one embodiment, the interrupt criteria is based on a table of turnaround conditions. The turnaround table scheme introduces the concept of "priority floors". For example, the elevator car may be commanded to turn around if any of the following sets of (floor number, service time, distance) exist (4fl, 20 sec, 1fl), (18fl, 60 sec, 2fl), 20fl, 30 sec, 10fl). Note in the latter case the $20^{th}$ floor, for example, has a high priority as interrupt occurs even when such interruption may be largely disadvantageous to existing passengers. An extension of this method may use dynamic priority, e.g. certain floors get priority at certain times or on certain days, or on the payment to building management of a "priority access premium". Priorities could vary based on some action (entry of code) or artifact (RFID tag, smart phone) of a rider. All of the above interrupts may be overridden by another system state, e.g. sensing that an elevator car is full and therefore unable to take on additional passengers, making the interrupt pointless. In another embodiment, interrupts beyond a threshold, either statically or dynamically set via rules or algorithmic means, may be prevented when, taken as whole, they severely impact the waiting time of original passengers by repeated interrupts and direction changes.

In this example, the distance between the current location of the elevator car 202 (e.g., the fourth floor 206*d*) and the location of the subsequent call request (e.g., the fifth floor 206*e*) satisfies a threshold value (e.g., is less than or equal to a distance of two floors). In response to satisfying the interrupt criteria, the elevator control module 203 overrides the first servicing route 208 and generates the second servicing route 210 having assigned thereto a second car travelling direction 212*b* that is opposite (e.g., up) from the first car travelling direction 212*a* (e.g., down).

Once the second servicing route 210 is generated, the elevator control module 203 interrupts travel in the first traveling direction 212*a* (e.g., downward) and generates a drive command signal that commands the elevator drive system to drive the elevator car in the second car travelling direction 212*b* (e.g., upward) so as to service the passenger 204*e* located at the fifth floor 206*e* (B). In at least one embodiment, the first elevator car 202 (i.e., the elevator control module 203) continues assigning call requests to the first servicing route 208 while servicing floors assigned to the second service route 210. Thereafter, the elevator control module 203 reinitiates the first servicing route 208 and drives the elevator car 202 in the first car travelling direction 212*a* which matches the desired travelling direction 209 of both passengers 204. Although FIG. 2 illustrates the final destination of the elevator car 202 ending at floor 1 206*a* (C), it should be appreciated that the elevator car 202 may also make additional stops along the first servicing route 208 (e.g., the third floor 206*c*, and/or the second floor 206*b*) before completing the first servicing route 208. In at least one embodiment, the first elevator car 202 may also perform additional services to one or floors added to the initial servicing route 208 based on call requests received during the initial servicing route interruption.

Figure 3A:
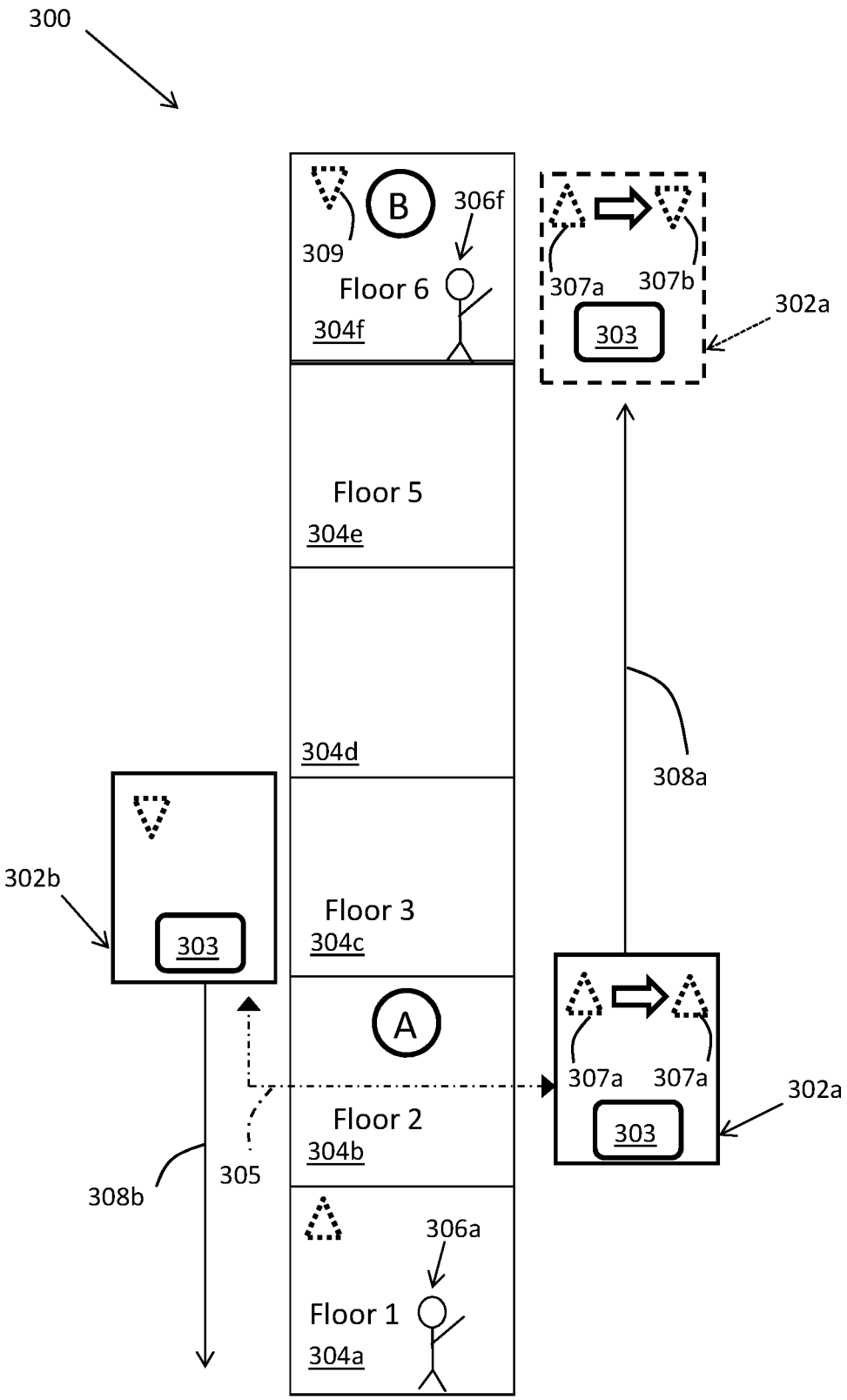
FIGS. 3A-3B are block diagrams illustrating an elevator system including dynamic car call scheduling according to another non-limiting embodiment.
Figure 3B:
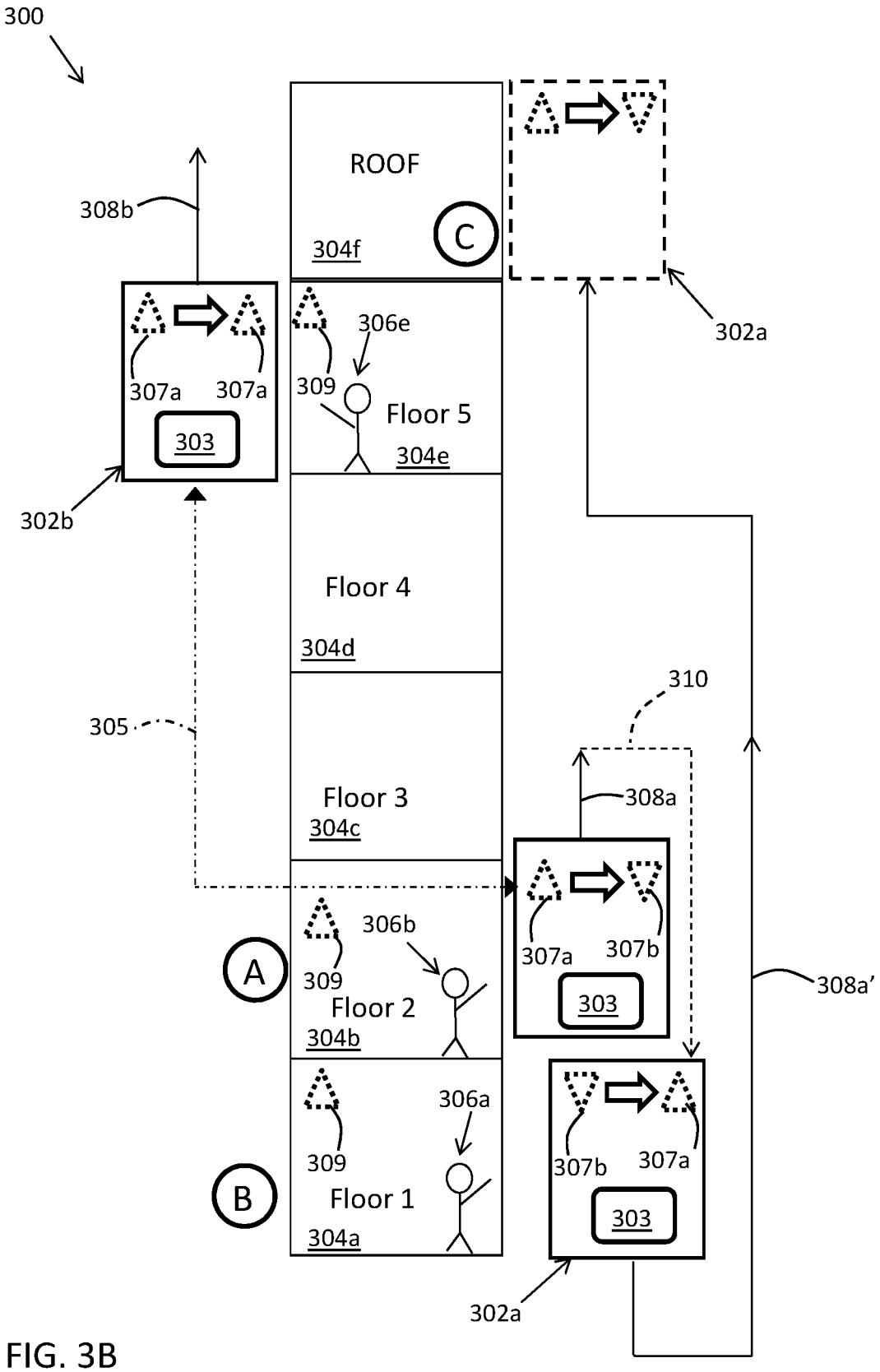

Turning now to FIGS. 3A-3B, an elevator system 300 including dynamic car call scheduling is illustrated according to another non-limiting embodiment. The elevator system 300 includes a plurality of elevator cars 302*a*-302*b* that services multiple floors 304*a*-304*f*. As previously described, an elevator control module 303 generates a drive control signal that controls an elevator drive system to operate the elevator cars 302*a*-302*b* in a first direction (e.g. upward direction) and a second direction (e.g., downward) direction. The elevator control module 303 may be installed in each elevator car 302*a*-302*b* or may be disposed in an area located remotely from the elevator cars 302*a*-302*b*. In at least one embodiment, a first elevator car 302*a* is in signal communication with a second elevator car 302*b* so as to exchange data therebetween. The exchanged data includes various elevator parameters including, but not limited to, current elevator location, current elevator car direction, current elevator speed, current load, etc.

As described above, the elevator control module 303 is configured to interrupt a first servicing route and generate a second servicing route to dynamically schedule service of one or more floors 304*a*-304*f* located in a second car traveling direction opposite the initial car traveling direction of the first servicing route. In addition, the elevator control module 303 illustrated in the elevator system 300 of FIGS. 3A-3B determines the second servicing route based on a comparison between at least one parameter of the first elevator car 302*a* and at least one second parameter of the second elevator car 302*b*.

In the scenario illustrated in FIG. 3A, for example, the first elevator car 302*a* receives a first call request (A) from a first passenger 306*f* located at the sixth floor 304*f*. Accordingly, the first elevator control module 303 generates an initial servicing route 308*a* and selects a first car traveling direction 307*a* (e.g., upward 307*a*) necessary to service the first servicing call request. Thereafter, a new waiting passenger 306*a* located on the first floor 304*a* inputs a subsequent call request.

The first elevator car 302*a* (e.g., the elevator control module) generates a communication signal 305 so as to communicate with the second elevator car 302*b* and obtains the parameters of the second elevator car 302*b*. For example, the first elevator car 302*a* obtains parameters which allows the first elevator car 302*a* (e.g., the control module 303) to determine that the second elevator car 302*b* is currently located at the third floor 304*c* and is operating according to a respective servicing route 308*b* currently headed in an opposing second direction (e.g., downward) toward the new waiting passenger 306*a* (i.e., the passenger located at the first floor 304*a*). Accordingly, the elevator control module 303 can compare the obtained elevator parameters to at least one interrupt criteria to determine whether to override the initial servicing route 308*a*, i.e., generate a second servicing route that interrupts the initial servicing route 308*a* such that the subsequent call request (i.e., the passenger at the first floor 304*a*) to service a new waiting passenger 306 can be performed.

In the scenario illustrated in FIG. 3A, the first elevator car 302*a* (e.g., the elevator control module) determines, for example, that the necessary interrupt criteria is not satisfied since the second elevator car 302*a* is located near the first floor and is currently heading the direction of the subsequent call request. Accordingly, the first elevator car 302*a* (e.g., the elevator control module 303) determines that the new waiting passenger 306*a* at the first floor 304*a* will not incur an excessive wait time, and maintains the first servicing route 308*a* along the first car traveling direction 307*a* such that the initial call request input by the passenger 306*f* waiting at the sixth floor 304*f* can be serviced (B). Thereafter, the elevator car 302*a* can be driven in an opposing car traveling direction 307*b* (e.g., downward 307*b*) so as to transport the passenger 306*f* loaded at the sixth floor 304*f* in the desired traveling direction 309.

Turning to FIG. 3B, the elevator system 300 is illustrated operating according to a different scenario. The first elevator car 302*a* receives an initial call request (A) from a passenger 306*d* located at the second floor 304*b*. In response to the initial call request, the first elevator car 302*a* (i.e., the elevator control module) generates an initial servicing route 308*a* heading in a first car traveling direction 307*a* as requested by the corresponding passenger 306*e*. Thereafter, a subsequent call request is input by a new waiting passenger 306*a* located at the first floor 304*a*. As described above, the first elevator car 302*a* (i.e., the elevator control module) generates a communication signal 305 so as to communicate with the second elevator car 302*b* and obtains the parameters of the second elevator car 302*b*.

In the scenario illustrated in FIG. 3B, however, the first elevator car 302*a* (i.e., the elevator control module 303) determines that the obtained elevator parameters satisfy at least one interrupt criteria. For instance, the first elevator car 302*a* (i.e., the elevator control module 303) determines that the second elevator car 302*b* is more than 2 floors away from the new waiting passenger 306*a* located on the first floor 304*a* which input the subsequent call request, and is currently operating according to an initial servicing route 308*b* with a car traveling direction 307*a* that is opposite from the new waiting passenger 306*a*. Accordingly, the first elevator car 302*a* (i.e., the elevator control module 303) determines that the new waiting passenger 306*a* will experience an excessive wait time based on the distance and current heading of the second elevator car 302*b*, and in response is programmed to override the initial servicing route 308*a*.

As described above, the first elevator car 302*a* (i.e., the elevator control module 303) interrupts (e.g., temporarily halts) the initial servicing route 308 (e.g., interrupts travel in the first traveling direction 307*a*) and generates a second servicing route 310 having an opposite car traveling direction (307*b*). Accordingly, the first elevator car 302*a* is driven downward to the first floor 304*a* to service the new waiting passenger 306*a* (B). In at least one embodiment, the first elevator car 302 (i.e., the elevator control module 303) continues adding call requests to the first servicing route 308*a* while servicing floors assigned to the second service route 310.

After completing the second servicing route 310 (i.e., after loading the new waiting passenger 306*a*), the first elevator car 302*a* (i.e., the elevator control module 303) reinitiates the initial servicing route 308' and drives the first elevator car 302*a* in the first car traveling direction 307*a* so as to deliver the initial passenger 306*b* and the newly loaded passenger 306*a* to their desired floor (C), e.g., the roof 304*f* located along the passengers' 306*a* and 306*b* desired traveling direction 309 to complete the initial servicing route 308'. Although the roof 304*f* is illustrated as the final destination of the first elevator car 302*a*, it should be appreciated that the first elevator car 302*a* may deliver the passengers 306*a* and 306*b* to any floor or floors located along the initial servicing route 308'. In at least one embodiment, the first elevator car 302*a* may also perform additional services to one or more floors added to the initial servicing route 308*a*' based on call requests received during the initial servicing route interruption.

Figure 4A:
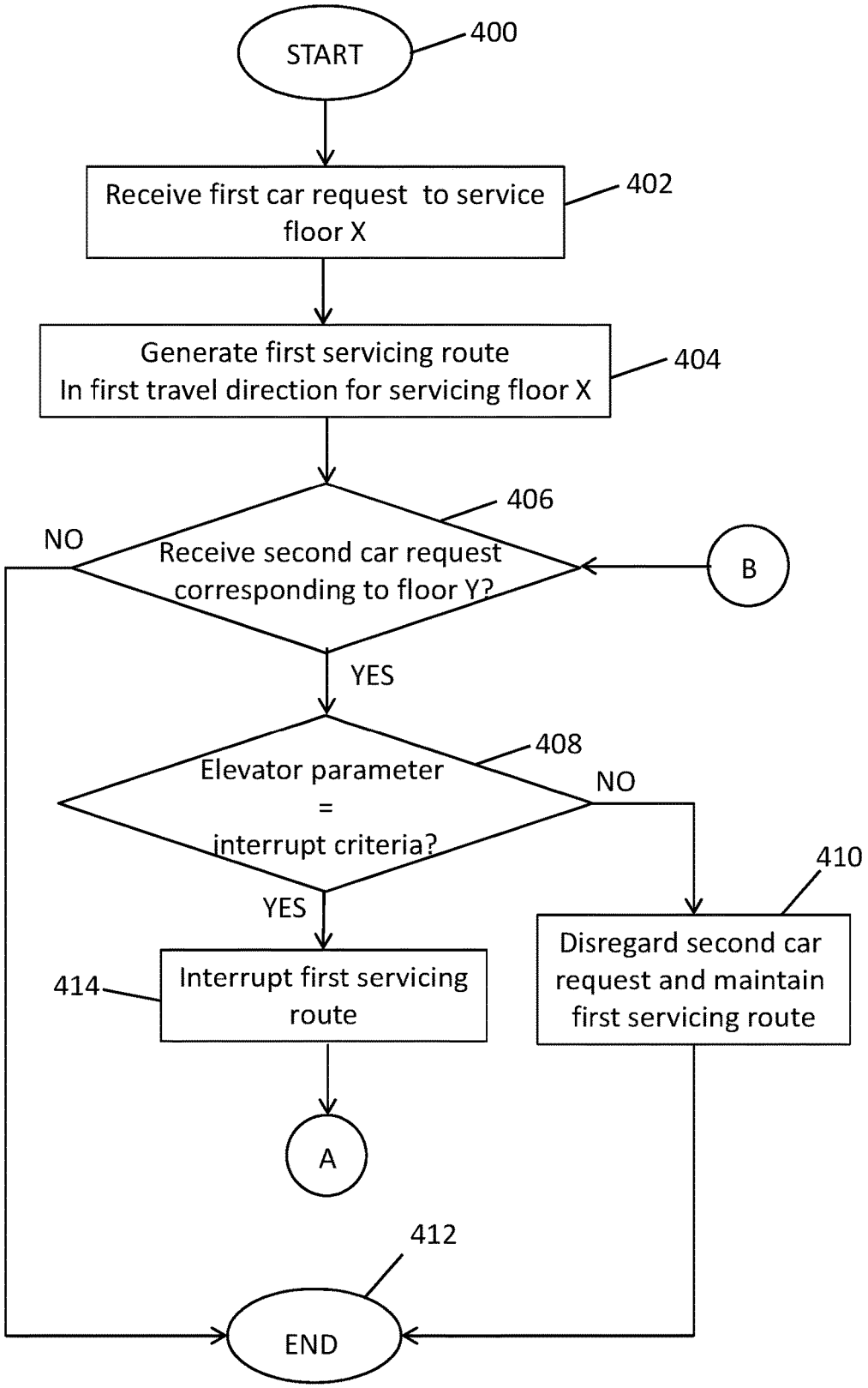
FIGS. 4A-4B is a flow diagram illustrating a method of dynamically scheduling a call request of at least one elevator car included in an elevator system according to a non-limiting embodiment.
Figure 4B:
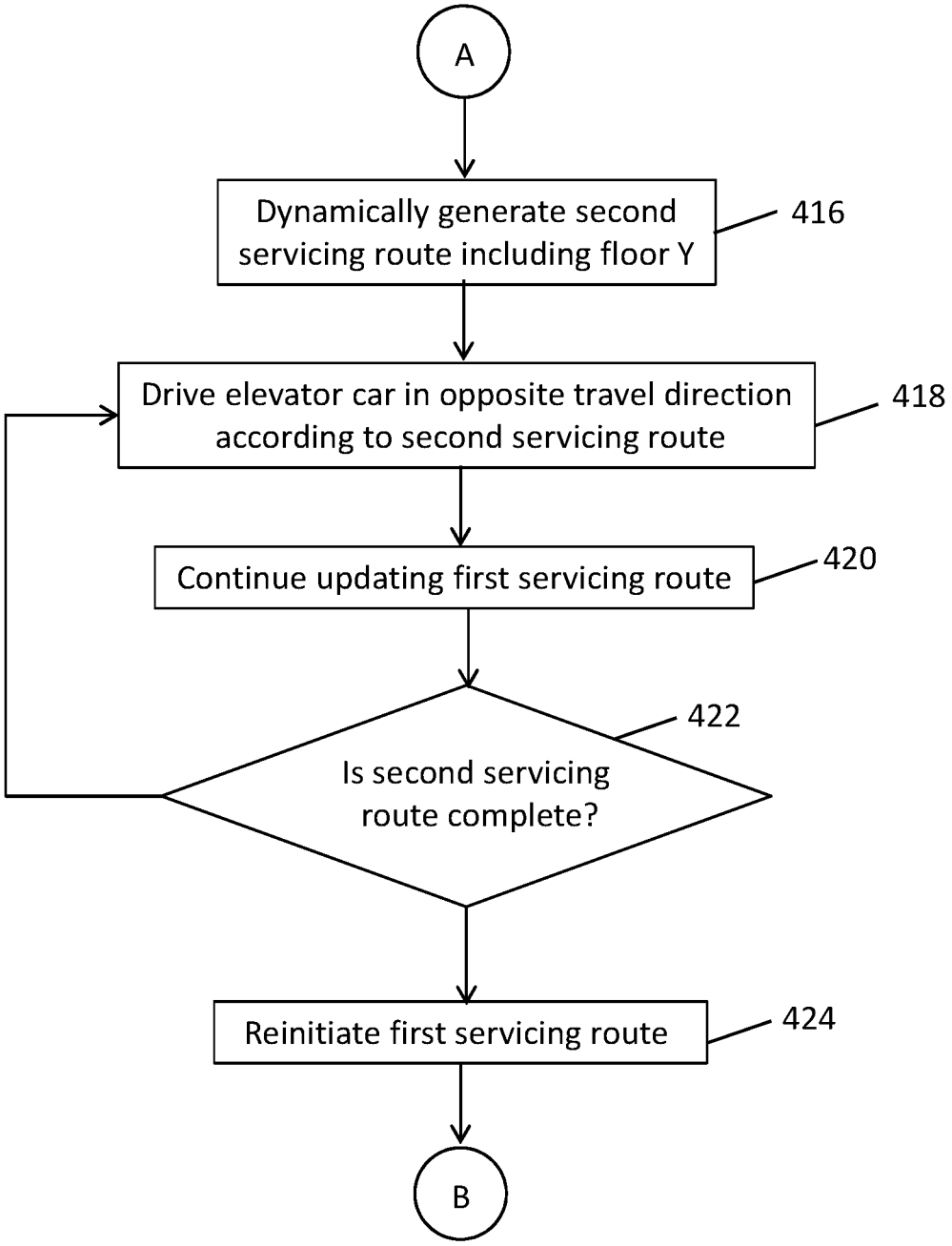

Referring now to FIGS. 4A-4B, a flow diagram illustrates a method of dynamically scheduling a call request of at least one elevator car included in an elevator system according to a non-limiting embodiment. The method begins at operation 400, and at operation 402 a first car request for servicing a first floor (floor X) is received. At operation 404, a first servicing route is generated and is assigned a first travelling direction to facilitate servicing of the first floor (floor X). At operation 406, a second car request corresponding to a second floor (floor Y) is received. At operation 408, one or more elevator parameters corresponding to the elevator car are compared to at least one interrupt criteria. In at least one embodiment, the elevator parameter is the current location (e.g., current floor) being serviced of the elevator and the interrupt criteria is the location of the second car request (e.g., a location of a waiting passenger that input the second car request). When the elevator parameter does not satisfy the interrupt criteria (e.g., the distance between the current location of the elevator car and the waiting passenger exceeds a threshold distance) the second car request input by the waiting passenger is disregarded and the first servicing route is maintained at operation 410. The method then ends at operation 412.

When, however, the elevator parameter satisfies the interrupt criteria at operation 408, the method proceeds to operation 414 and interrupts the first servicing route. At operation 416 (see FIG. 4B) a second servicing route is dynamically generated. That is, a second servicing route is generated in which the second floor (floor Y) is dynamically assigned to the second servicing route. At operation 418, the elevator car is then driven in the opposite travelling direction according to the second servicing route. For example, if the first servicing route was assigned a downward travelling direction, the second servicing route is assigned an upward travelling direction and the elevator car is driven upward to facilitate servicing of the waiting passenger. If the second servicing route is not completed at operation 422 (i.e., the elevator car is still in the process of travelling to floor Y), the method returns to operation 418 and continues to drive the elevator car in the opposite travelling direction. When, however, the second servicing route is complete, the first servicing route is reinstated at operation 424 and the method returns to operation 406 (see FIG. 4A) to determine whether a subsequent second servicing request has been received. If not further second servicing request is received, the method ends at operation 422. Otherwise, the method re-executes the operations starting at operation 408 according to the descriptions above.

As described above, various non-limiting embodiments provide an elevator system configured to interrupt an initial servicing route and generate a second servicing route so as to dynamically schedule servicing of new call requests based on a comparison between one or more elevator parameters and at least one interrupt criteria. In this manner, the elevator system according to at least one non-limiting embodiment is not required to complete the first servicing route before servicing the passenger waiting at the second floor. As a result, the waiting time of the new waiting passenger may be significantly reduced.

As used herein, the term "module" refers to an application specific integrated circuit (ASIC), an electronic circuit, an electronic computer processor (shared, dedicated, or group) and memory that executes one or more software or firmware programs, a combinational logic circuit, a microcontroller, and/or other suitable components that provide the described functionality. When implemented in software, a module can be embodied in memory as a non-transitory machine-readable storage medium readable by a processing circuit and storing instructions for execution by the processing circuit for performing a method.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. An elevator system, comprising:

at least one elevator car;

an elevator drive system configured to drive the at least one elevator car in a first direction and a second opposing direction based on at least one drive command signal; and an electronic elevator control module configured to determine a first servicing route for servicing a first floor located along the first direction in response to at least one first call request, and to determine a second servicing route that overrides the first servicing route so as to dynamically service at least one second floor located along the second direction based on a comparison between at least one parameter of the at least one elevator car and at least one interrupt criteria, wherein the at least one elevator car travels to the first floor to load a passenger having designated a desired traveling direction that matches the first direction for reaching a desired destination floor, and after loading the passenger at the first floor interrupting travel in the first direction and driving the at least one elevator car in the second direction opposite the first direction without delivering the passenger to the desired destination floor to travel to the at least one second floor, and wherein the electronic elevator control module reinitiates the first servicing route after loading of a passenger at the at least one second floor and commands the drives system to drive the at least one elevator car in the desired traveling direction.

2. The elevator system of claim 1, wherein the elevator control module is configured to generate a first drive command signal so as to drive the at least one elevator car in the first direction in response to receiving the at least one first call request corresponding to a first floor located in the first direction, and to generate a second drive command signal in response to receiving at least one second call request corresponding to the at least one second floor located in the second opposing direction.

3. The elevator system of claim 2, wherein the second drive command signal interrupts the travel in the first direction and drives the at least one elevator car in the second direction in response to the at least one elevator car satisfying the at least one interrupt criteria.

4. The elevator system of claim 3, wherein the second drive command is generated before the at least one elevator car completes the at least one first call request.

5. The elevator system of claim 1, wherein the at least one parameter includes a current position of the at least one elevator car, and wherein the at least one interrupt criteria includes a floor location corresponding to a second call request.

6. The elevator system of claim 5, wherein the elevator control module interrupts the first servicing route when a distance between the current position of the at least one elevator car and the floor location corresponding to the second call request is less than or equal to a threshold distance.

7. The elevator system of claim 6, wherein the elevator control module continues scheduling the at least one first call request while servicing the at least one second floor assigned to the second service route.

8. The elevator system of claim 1, wherein the at least one elevator car includes a first elevator car in signal communication with a second elevator car, and wherein the first elevator car determines the second servicing route that overrides the first servicing route so as to travel to at least one second floor located along the second direction based on a comparison between the at least one parameter of the first elevator car and at least one second parameter of the second elevator car.

9. The elevator system of claim 8, wherein the at least one parameter includes a current position of the first elevator car, and wherein the at least one second parameter includes at least one of a current position of the second elevator car and a current servicing route of the second elevator car.

10. A method of scheduling a call request of at least one elevator car included in an elevator system, the method comprising:

configuring the at least one elevator car to travel in a first travel direction and an opposing second travel direction based on at least one drive command signal;

determining a first servicing route for servicing a first floor located along the first travel direction in response to at least one first call request;

comparing at least one parameter of the at least one elevator car and at least one interrupt criteria; and overriding the first service route and dynamically scheduling at least one second floor to be serviced in an opposing second travel direction according to a second servicing route in response to the at least one parameter satisfying the at least one interrupt criteria, wherein overriding the first service route comprises:

traveling, via the at least one elevator car, to the first floor to load a passenger having designated a desired traveling direction that matches the first direction for reaching a desired destination floor;

interrupting travel in the first direction after loading the passenger at the first floor and driving the at least one elevator car in the second direction opposite the first direction without delivering the passenger to the desired destination floor to travel to the at least one second floor, and reinitiating the first servicing route after loading of the passenger at the at least one second floor and commands the drive system to drive the at least one elevator car in the desired traveling direction.

11. The method of claim 10, further comprising generating a first drive command signal so as to drive the at least one elevator car in the first travel direction in response to receiving the at least one first call request corresponding to a first floor located in the first travel direction, and generating a second drive command signal in response to receiving at least one second call request corresponding to the at least one second floor located in the opposing second travel direction.

12. The method of claim 11, further comprising interrupting the travel in the first travel direction and driving the at least one elevator car in the opposing second travel direction in response to the at least one elevator car satisfying the at least one interrupt criteria.

13. The method of claim 12, further comprising interrupting the first servicing route before the at least one elevator car completes the at least one first call request.

14. The method of claim 10, wherein the at least one parameter includes a current position of the at least one elevator car, and wherein the at least one interrupt criteria includes a floor location corresponding to a second call request.

15. The method of claim 14, further comprising interrupting the first servicing route when a distance between the current position of the at least one elevator car and the floor location corresponding to the second call request is less than or equal to a threshold distance.

16. The method of claim 15, further comprising continuously scheduling the at least one first call request while servicing the at least one second floor assigned to the second service route.

17. The method of claim 10, wherein the at least one elevator car includes a first elevator car in signal communication with a second elevator car, and wherein the first elevator car determines the second servicing route that overrides the first servicing route so as to travel to at least one second floor located along the opposing second travel direction based on a comparison between the at least one parameter of the first elevator car and at least one second parameter of the second elevator car.

18. The method of claim 17, wherein the at least one parameter includes a current position of the first elevator car, and wherein the at least one second parameter includes at least one of a current position of the second elevator car and a current servicing route of the second elevator car.

* * * * *